US008308260B2

(12) United States Patent
Kaneko

(10) Patent No.: US 8,308,260 B2
(45) Date of Patent: Nov. 13, 2012

(54) LIQUID DISCHARGING APPARATUS, LIQUID DISCHARGING METHOD, AND DISCHARGE PULSE SETTING METHOD

(75) Inventor: Tomoshige Kaneko, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 245 days.

(21) Appl. No.: 12/709,339

(22) Filed: Feb. 19, 2010

(65) Prior Publication Data

US 2010/0214335 A1 Aug. 26, 2010

(30) Foreign Application Priority Data

Feb. 20, 2009 (JP) ..... 2009-038361

(51) Int. Cl.
*B41J 29/38* (2006.01)

(52) U.S. Cl. ..... 347/11

(58) Field of Classification Search ..... 347/9–11, 347/68

See application file for complete search history.

(56) References Cited

U.S. PATENT DOCUMENTS 6,685,293 B2 2/2004 Junhua

FOREIGN PATENT DOCUMENTS

| | | |
|---|---|---|
| JP | 2002-225250 A | 8/2002 |
| JP | 2003-145760 A | 5/2003 |
| JP | 2006-167534 A | 6/2006 |
| JP | 2007-245475 A | 9/2007 |

*Primary Examiner* — An Do

(74) *Attorney, Agent, or Firm* — Kilpatrick Townsend & Stockton LLP

(57) ABSTRACT

A liquid discharging apparatus includes: a pressure chamber communicated with a nozzle; an element which performs the operation of imparting a pressure change to liquid in the pressure chamber; and a pulse generation section which generates a preceding discharge pulse and a following discharge pulse that operate the element, and determines a period from the end of the generation of the preceding discharge pulse to the start of the generation of the following discharge pulse in accordance with the liquid droplet amount which is discharged from the nozzle.

8 Claims, 11 Drawing Sheets

| | DISCHARGE FREQUENCY (INTERVAL) | AMOUNT OF INK |
|---|---|---|
| F0 | 4.0 kHz (250.0 μs) | X0 ng |
| F1 | 11.5 kHz (87.0 μs) | X1 ng |
| F2 | 20.0 kHz (50.0 μs) | X2 ng |
| F3 | 31.7 kHz (31.5 μs) | X3 ng |
| F4 | 40.0 kHz (25.0 μs) | X4 ng |
| F5 | 50.0 kHz (20.0 μs) | X5 ng |
| F6 | 54.0 kHz (18.5 μs) | X6 ng |
| F7 | 57.0 kHz (17.5 μs) | X7 ng |

LIQUID DISCHARGING APPARATUS, LIQUID DISCHARGING METHOD, AND DISCHARGE PULSE SETTING METHOD

This application claims priority to Japanese Patent Application No. 2009-038361, filed Feb. 20, 2009, the entirety of which is incorporated by reference herein.

BACKGROUND

1. Technical Field

The present invention relates to a liquid discharging apparatus, a liquid discharging method, and a discharge pulse setting method.

2. Related Art

In a liquid discharging apparatus such as an ink jet printer, in general, the discharge amount of liquid was determined by the waveform of a discharge pulse, and also a distance between the discharge pulses which are included in a repetition period was determined based on a landing position of ink droplets (for example, refers to JP-A-2002-225250).

In a liquid discharging apparatus, if the discharge amount of liquid can be changed, this is preferable since fine control can be possible. However, in the case of changing the discharge amount of liquid being determined by the shape of the waveform of a discharge pulse, kind of shapes of the waveforms which correspond to the kinds of discharge amounts are needed. Or, it is not suitable for high-frequency discharge of liquid.

SUMMARY

An advantage of some aspects of the invention is that it increases the degree of freedom related to the discharge amount of liquid.

According to a first aspect of the invention, there is provided a liquid discharging apparatus including: a pressure chamber communicated with a nozzle; an element which performs the operation of imparting a pressure change to liquid in the pressure chamber; and a pulse generation section which generates a preceding discharge pulse and a following discharge pulse that operate the element, and determines a period from the end of the generation of the preceding discharge pulse to the start of the generation of the following discharge pulse in accordance with the liquid droplet amount which is discharged from the nozzle.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
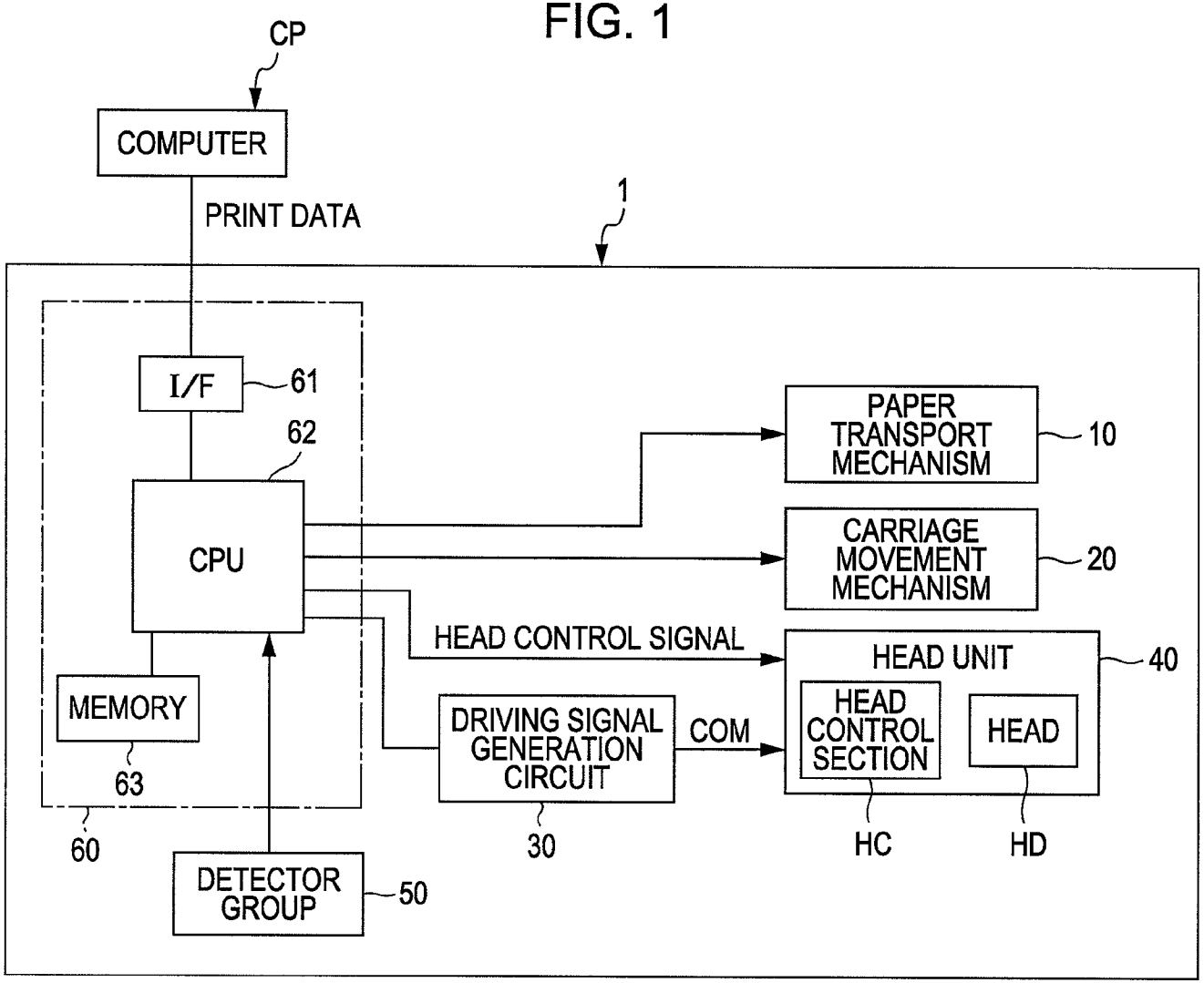
FIG. 1 is a block diagram explaining the configuration of a printing system.

At least the following aspects will become apparent from the description of this specification and the description of the accompanying drawings.

That is, it will become apparent that a liquid discharging apparatus can be realized which includes: a pressure chamber communicated with a nozzle; an element which performs the operation of imparting a pressure change to liquid in the pressure chamber; and a pulse generation section which generates a preceding discharge pulse and a following discharge pulse that operate the element, and determines a period from the end of the generation of the preceding discharge pulse to the start of the generation of the following discharge pulse in accordance with the liquid droplet amount which is discharged from the nozzle.

According to this liquid discharging apparatus, since the liquid droplet amount which is discharged is determined in accordance with a distance between the preceding discharge pulse and the following discharge pulse, it is possible to change the liquid droplet amount by the smaller kinds of discharge pulses than the case of using a discharge pulse for exclusive use. Therefore, it is possible to increase the degree of freedom related to the discharge amount of liquid.

In the liquid discharging apparatus, it is preferable that the pulse generation section repeatedly generates the preceding discharge pulse and the following discharge pulse for every repetition period, and also determines a period from the end of the generation of the preceding discharge pulse, which is generated in the same repetition period, to the start of the generation of the following discharge pulse in accordance with the liquid droplet amount which is discharged from the nozzle.

According to this liquid discharging apparatus, it is possible to determine the amount of liquid droplet discharged with the repetition period used as a unit.

In the liquid discharging apparatus, it is preferable that the apparatus further include a pulse application section which selectively applies the preceding discharge pulse and the following discharge pulse to the element.

According to this liquid discharging apparatus, it is possible to increase the degree of freedom related to the discharge amount of liquid, in accordance with the selection manner of the discharge pulse.

In the liquid discharging apparatus, it is preferable that the pulse generation section generates three discharge pulses or more in the repetition period, and the pulse application section determines a combination of the preceding discharge pulse and the following discharge pulse, which is applied to the element, in accordance with the liquid droplet amount which is discharged from the nozzle.

According to this liquid discharging apparatus, it is possible to further increase the degree of freedom related to the discharge amount of liquid in accordance with the selection manner of the discharge pulse.

In the liquid discharging apparatus, it is preferable that the pulse generation section include: a first pulse generation section which generates a first preceding discharge pulse and a first following discharge pulse; and a second pulse generation section which generates a second preceding discharge pulse and a second following discharge pulse, such that a period from the end of the generation of the second preceding discharge pulse to the start of the generation of the second following discharge pulse is different from a period from the end of the generation of the first preceding discharge pulse to the start of the generation of the first following discharge pulse.

According to this liquid discharging apparatus, since the preceding discharge pulse and the following discharge pulse are generated into the plural kinds of pulses, it is possible to further increase the degree of freedom related to the discharge amount of liquid.

In the liquid discharging apparatus, it is preferable that the preceding discharge pulse and the following discharge pulse have the same waveform.

According to this liquid discharging apparatus, the discharge pulses can be easily generated.

Further, it will also become apparent that the following liquid discharging method can be realized.

That is, it will also become apparent that a liquid discharging method of discharging liquid from a nozzle by using a liquid discharging apparatus which includes a pressure chamber communicated with the nozzle, an element which performs the operation of imparting a pressure change to liquid in the pressure chamber, and a pulse generation section which generates pulses that operate the element can be realized which the method includes: generating a preceding discharge pulse which operates the element; operating the element by the preceding discharge pulse; generating a following discharge pulse after a period which is determined in accordance with the liquid droplet amount discharged from the nozzle, has elapsed since the end of the generation of the preceding discharge pulse; and operating the element by the following discharge pulse.

Further, it will also become apparent that the following discharge pulse setting method can be realized.

That is, it will also become apparent that a discharge pulse setting method of a liquid discharging apparatus which includes a liquid discharge head provided with a pressure chamber communicated with a nozzle, and an element which performs the operation of imparting a pressure change to liquid in the pressure chamber; and a pulse generation section which generates a preceding discharge pulse and a following discharge pulse, which operate the element can be realized which the setting method includes: determining a period from the end of the generation of the preceding discharge pulse to the start of the generation of the following discharge pulse in accordance with the discharge characteristic information of the liquid discharge head.

According to the discharge pulse setting method, a discharge characteristic variation can be suppressed in accordance with a distance between the discharge pulses.

First Embodiment

Concerning Printing System

A printing system illustrated in FIG. 1 includes a printer 1 and a computer CP. The printer 1 corresponds to a liquid discharging apparatus and discharges ink which is one type of liquid, toward a medium such as paper, cloth, or film. The medium is an object which becomes a target to which liquid is discharged. The computer CP is connected to the printer 1 so as to be able to communicate with each other. In order to make the printer 1 print an image, the computer CP transmits print data corresponding to the image to the printer 1.

Overview of Printer 1

The printer 1 includes a paper transport mechanism 10, a carriage movement mechanism 20, a driving signal generation circuit 30, a head unit 40, a detector group 50, and a main control section 60.

The paper transport mechanism 10 corresponds to a medium transport section and transports a paper as the medium in a transport direction. The carriage movement mechanism 20 corresponds to a head movement section and moves a carriage on which the head unit 40 is mounted, in a given moving direction (for example, a paper width direction (corresponding to a crossing direction intersecting with the transport direction)). The driving signal generation circuit 30 generates a driving signal COM. The driving signal COM is a signal which is applied to a head HD (a piezo element 45; referring to FIG. 2) at the time of printing onto the paper, and a successive signal which includes discharge pulses PS, as shown as one example in FIG. 5. Here, the discharge pulse PS is a change pattern, namely, a waveform, of a voltage which makes the piezo element 45 perform a given operation in order to discharge droplet-like ink from a nozzle 44 provided in the head HD. Since the driving signal COM includes the discharge pulses PS, the driving signal generation circuit 30 and the main control section which outputs a control signal (DAC data) correspond to a pulse generation section. On the other hand, the configuration of the driving signal generation circuit 30 and the discharge pulse PS will be described later. The head unit 40 has the head HD and a head control section HC. The head HD is one type of a liquid discharge head and discharges ink toward the paper. The head control section HC controls the head HD on the basis of a head control signal from the main control section 60. Further, the head HD will be described later. The detector group 50 is constituted of a plurality of detectors which monitor the conditions of the printer 1. The detection results of these detectors are outputted to the main control section 60. The main control section 60 performs the overall control in the printer 1. The main control section 60 will also be described later.

Principal Sections of Printer 1

Concerning Head HD

Figure 2:
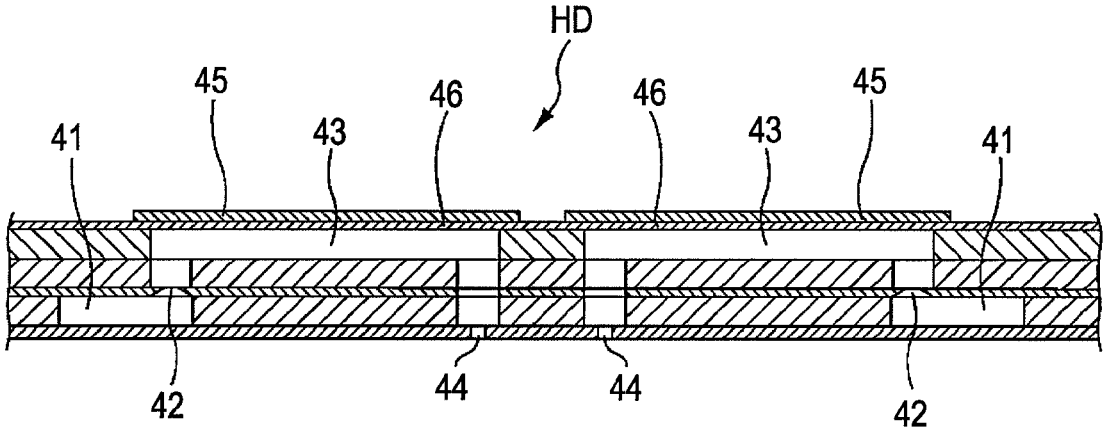
FIG. 2 is a cross-sectional view of a head.

As shown in FIG. 2, the head HD includes a common ink chamber 41, an ink supply port 42, a pressure chamber 43, and the nozzle 44. Also, a successive ink flow path (corresponding to a liquid flow path which is filled with liquid) extending from the common ink chamber 41 to the nozzle 44 through the pressure chamber 43 is provided in a plurality of numbers corresponding to the number of nozzles 44. The common ink chamber 41 is a portion in which the ink from an ink cartridge (not shown) is stored, and corresponds to a common liquid chamber. The ink supply port 42 is a throttle flow path for supplying the ink retained in the common ink chamber 41 to the pressure chamber 43 and is one type of a liquid supply portion. The pressure chamber 43 is a portion for imparting a pressure change to the ink in the ink flow path. The nozzle 44 is a portion which discharges ink, and is communicated with the pressure chamber 43.

In the head HD, the volume of the pressure chamber 43 is changed by the operation of the piezo element 45. That is, a portion of the pressure chamber 43 is partitioned by a vibration plate 46, and the piezo element 45 is provided on the surface of the vibration plate 46, which is the opposite side to the pressure chamber 43. The piezo elements 45 are provided correspondingly to the respective pressure chambers 43. Each piezo element 45 is constituted by, for example, an upper electrode, a lower electrode, and a piezoelectric body interposed between the upper and lower electrodes (any of these portions is not shown) and is deformed by applying a difference in electrical potential between the electrodes. In this example, if the electrical potential of the upper electrode rises, the piezoelectric body is electrically charged. According to this, the piezo element 45 is bent to become convex to the pressure chamber 43 side, thereby contracting the pressure chamber 43. To the contrary, if the electrical potential of the upper electrode is lowered, the piezoelectric body is electrically discharged, so that the extent of deflection is loosened, whereby the volume of the pressure chamber 43 is expanded by the extent.

In the head HD, the portion where the pressure chamber 43 is partitioned by the vibration plate 46 corresponds to a partitioning portion and is deformed in accordance with the deformation of the piezo element 45, thereby imparting a pressure change to the ink in the pressure chamber 43. In the head HD, a pressure change is imparted to the ink in the pressure chamber 43, and an ink droplet is discharged by using the pressure change.

Concerning Ink Flow Path

Figure 3:
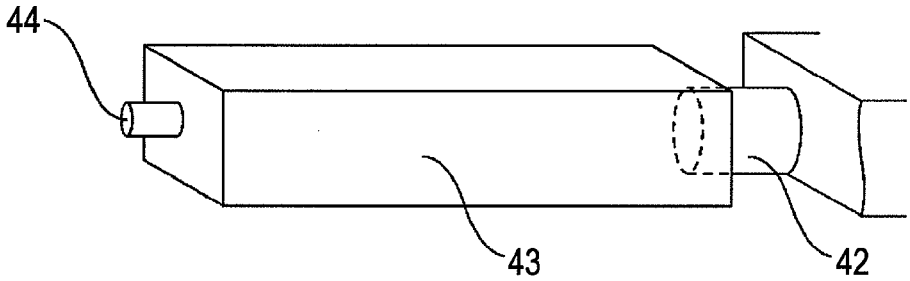
FIG. 3 is a view schematically explaining the structure of an ink flow path.

As described above, in the head HD, an ink flow path is provided for every nozzle 44. In the ink flow path, the pressure chamber 43 is communicated with the nozzle 44 and the ink supply port 42, respectively. Therefore, in the case of analyzing the characteristics such as the flow of ink, the conception of a Helmholtz resonator is applied. FIG. 3 is a view schematically explaining the structure of the ink flow path based on the conception. Due to schematic illustration, in FIG. 3, the ink flow path is shown in a different shape from the fact.

In the ink flow path, a pressure change is imparted to the ink in the pressure chamber 43, so that the ink is discharged from the nozzle 44. At this time, the pressure chamber 43, the ink supply port 42, and the nozzle 44 function like the Helmholtz resonator. Therefore, if pressure is added to the ink in the pressure chamber 43, the magnitude of the pressure varies with a specific period called a Helmholtz period Tc. That is, pressure vibration occurs in ink.

Here, the Helmholtz period (the specific vibration period of ink) Tc can be generally expressed by the following equation (1).

$$Tc=1/f$$

$$f=\tfrac{1}{2}\pi\sqrt{[(Mn+Ms)/(Mn\times Ms\times(Cc+Ci))]} \quad (1)$$

In Equation (1), Mn is the inertance of the nozzle 44 (the mass of ink per unit cross-sectional area), Ms is the inertance of the ink supply port 42, Cc is the compliance (representing a volumetric change per unit pressure, and the extent of tenderness) of the pressure chamber 43, and Ci is the compliance of ink (Ci=volume V/[density ρ×sonic speed $c^2$]).

As ink flows in the ink flow path, the amplitude of the pressure vibration is gradually reduced. The pressure vibration attenuates due to, for example, a loss in the nozzle 44 or the ink supply port 42 and a loss in a wall portion which partitions the pressure chambers 43, etc.

In a general head HD, the Helmholtz period Tc in the pressure chamber 43 is determined in the range from 5 μs to 10 μs. Also, the Helmholtz period Tc also varies according to the thickness of the wall portion which partitions adjacent pressure chambers 43, the thickness or the compliance of the vibration plate 46, or the material or the thickness of a nozzle plate.

Concerning Main Control Section 60

The main control section 60 (main controller) performs the overall control in the printer 1. For example, the main control section controls controlled objects on the basis of the print data received from the computer CP or the detection result from each detector, so as to print an image on the paper. As shown in FIG. 1, the main control section 60 has an interface 61, a CPU 62, and a memory 63. The interface 61 performs the delivery and receipt of data between the printer and the computer CP. The CPU 62 performs the overall control of the printer 1. The memory 63 secures a region which stores a computer program, a working region, or the like. The CPU 62 controls each controlled object in accordance with the computer program stored in the memory 63. For example, the CPU 62 controls the paper transport mechanism 10 or the carriage movement mechanism 20. Further, the CPU 62 transmits a head control signal for controlling the operation of the head HD to the head control section HC, or transmits a control signal for generating the driving signal COM to the driving signal generation circuit 30.

Here, the control signal for generating the driving signal COM is also called DAC data and is, for example, plural-bit digital data. The DAC data determines the change pattern of a voltage in the driving signal COM which is generated. Accordingly, it can be said that the DAC data is data representing the voltage of the driving signal COM (discharge pulse PS). The DAC data is stored in a given region of the memory 63, and is read and outputted to the driving signal generation circuit 30 at the time of the generation of the driving signal COM.

Concerning Driving Signal Generation Circuit 30

Figure 4:
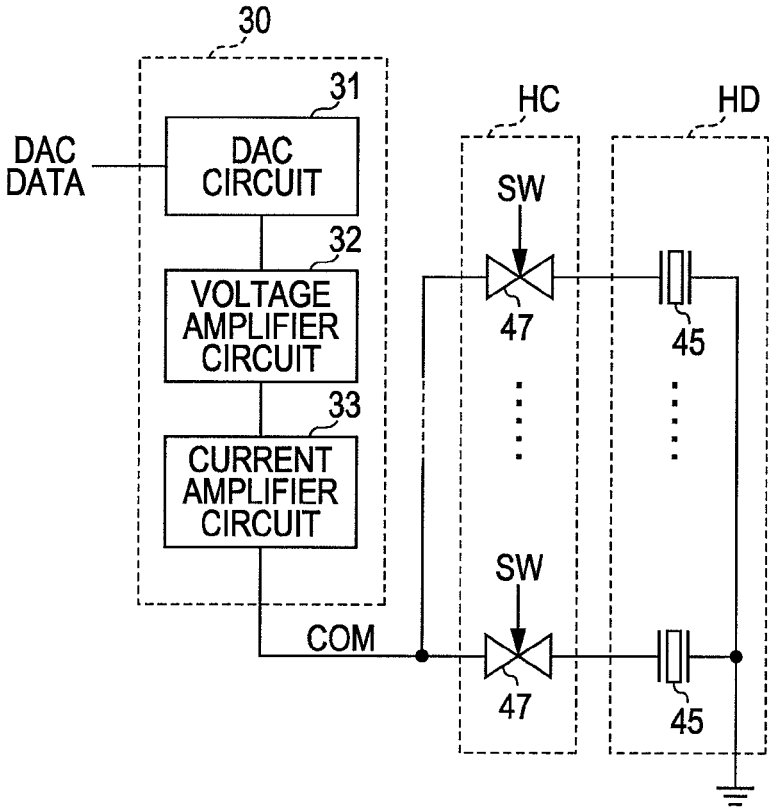
FIG. 4 is a block diagram explaining the configuration of a driving signal generation circuit, etc.

The driving signal generation circuit 30 functions as a pulse generation section along with the main control section 60 and generates the driving signal COM including the discharge pulses PS on the basis of the DAC data. As shown in FIG. 4, the driving signal generation circuit 30 has a DAC circuit 31, a voltage amplifier circuit 32, and a current amplifier circuit 33. The DAC circuit 31 converts digital DAC data into an analog signal. The voltage amplifier circuit 32 amplifies the voltage of the analog signal converted in the DAC circuit 31 up to a level capable of driving the piezo element 45 and outputs it as a waveform signal. The current amplifier circuit 33 performs current amplification on the waveform signal from the voltage amplifier circuit 32 and outputs it as the driving signal COM. The current amplifier circuit 33 is constituted by, for example, a push-pull connected transistor pair.

Concerning Head Control Section HC

The head control section HC selects the necessary portion of the driving signal COM generated by the driving signal generation circuit 30 on the basis of the head control signal and applies it to the piezo element 45. Therefore, the head control section HC has a plurality of switches 47 each provided for every piezo element 45, on the way of the supply line of the driving signal COM, as show in FIG. 4. The head control section HC generates a switch control signal from the head control signal. By controlling each switch 47 by the switch control signal, the necessary portion, for example, the discharge pulse PS, of the driving signal COM is applied to the piezo element 45. At this time, the discharge of the ink from the nozzles 44 can be controlled in accordance with the selection manner of the necessary portion. For example, the necessary discharge pulse PS can be selected in accordance with a dot gradation and applied to the piezo element 45. Such a head control section HC corresponds to a pulse application section which selects the discharge pulse PS included in the driving signal COM in accordance with the head control signal from the main control section 60 and applies it to the piezo element 45.

Concerning Driving Signal COM

Figure 5:
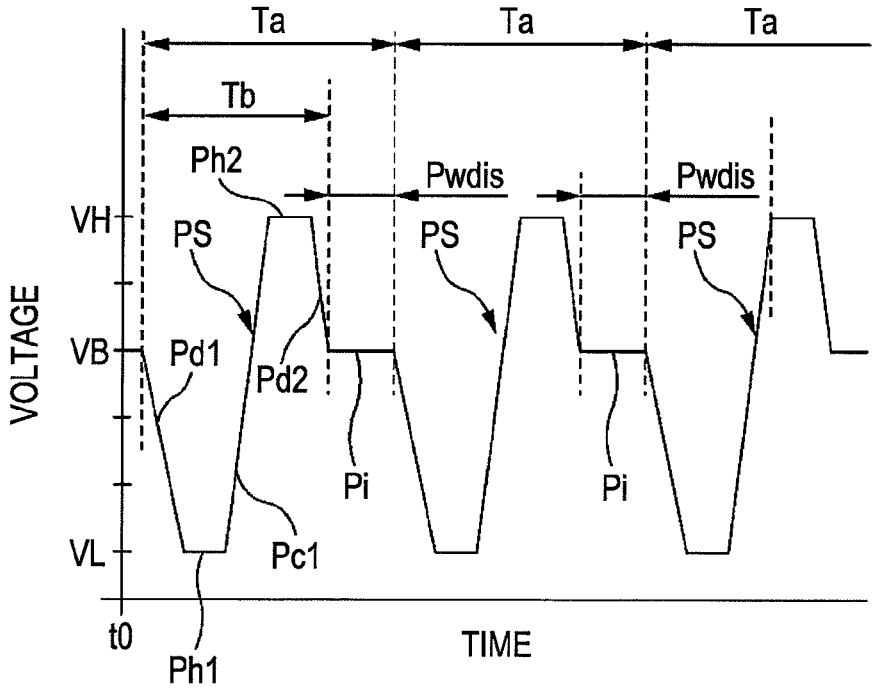
FIG. 5 is a view explaining one example of a driving signal.

Next, an outline of the driving signal COM which is generated by the driving signal generation circuit 30 is explained. As shown in FIG. 5, a number of discharge pulses PS which are repeatedly generated are included in the driving signal COM. These discharge pulses PS have the same waveform. That is, the change patterns of voltages are the same. As described above, the driving signal COM is applied to the upper electrode of the piezo element 45. In this way, a difference in electrical potential according to a waveform occurs between the upper electrode and a common electrode having a fixed potential. As a result, the piezo element 45 is deformed in accordance with the waveform, thereby changing the volume of the pressure chamber 43. The illustrated discharge pulse PS has a first decompression portion Pd1, a first hold portion Ph1, a pressurization portion Pc1, a second hold portion Ph2, and a second decompression portion Pd2. On the other hand, an operation when each of these portions is applied to the piezo element 45 will be described later.

In the driving signal COM, a constant voltage portion Pi is generated between the discharge pulses PS. Also, an interval Ta in which each discharge pulse PS is applied to the piezo element 45 is determined in accordance with a generation period Pwdis of the constant voltage portion Pi. That is, an ink droplet discharge frequency is determined by a period which added a necessary period Tb for the generation of the discharge pulse PS and the generation period Pwdis of the constant voltage portion Pi.

Features of Printer 1

Concerning the Amount of Ink and Discharge Frequency

In the printer 1, it was found that even in a case where the discharge pulses PS having the same waveform are used, the amount of ink per one droplet is changed by changing the discharge frequency. That is, it was found that even at the same discharge pulse PS, the amount of ink per one droplet is changed by changing the generation period Pwdis of the constant voltage portion Pi.

Figures 6A, 6B:
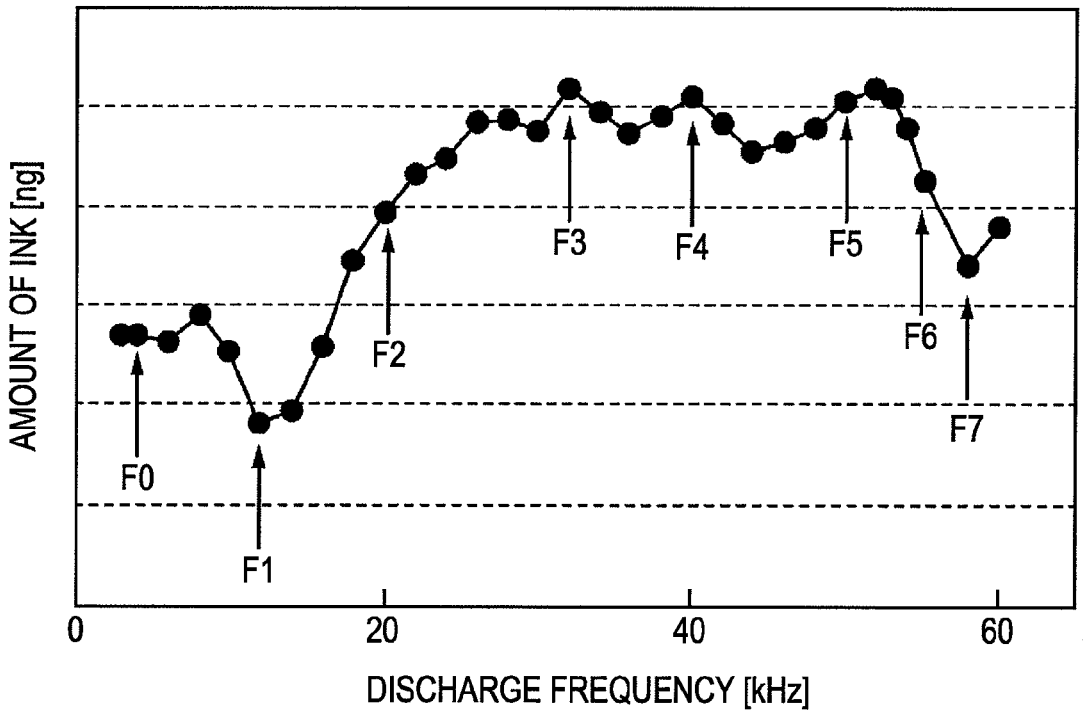
FIG. 6A is a graph showing the frequency dependency of the amount of ink.
FIG. 6B is data explaining the relationship between a discharge frequency and the amount of ink.

Here, FIG. 6A is a graph showing the frequency dependency of the amount of ink. Also, FIG. 6B is data explaining a relationship between the discharge frequency and the amount of ink at each point of FIG. 6A. As can be seen from these drawings, the amount of ink of one droplet corresponding to a discharge frequency F0 (4 kHz) becomes X0. In the discharge frequency F0, each discharge pulse PS is generated with a period of 250 μs and applied to the piezo element 45. Therefore, the residual vibration of the Helmholtz period Tc, which was generated by the application of the prior discharge pulse PS to the piezo element 45, is sufficiently attenuated until the posterior discharge pulse PS is applied to the piezo element 45. Accordingly, it can be said that the amount of ink, X0, corresponding to the discharge frequency F0 is the amount of ink which is discharged when the discharge pulse PS was solely applied to the piezo element 45.

The amount of ink of one droplet corresponding to a discharge frequency F1 (11.5 kHz) is X1. The amount of ink, X1, is smaller than the amount of ink, X0, and is a minimum amount in the entire range of the discharge frequencies (to 60 kHz). The amount of ink of one droplet corresponding to a discharge frequency F2 (20.0 kHz) is X2. The amount of ink, X2, is larger than the amount of ink, X0. In the printer 1, the discharge amount becomes a maximum in the range of the discharge frequencies of 30 kHz or more and 50 kHz or less. Also, the amount of ink, X2, becomes an intermediate discharge amount between the minimum amount of ink, X1, and the maximum amount of ink, X3. The amounts of ink corresponding to a discharge frequency F3 (31.7 kHz), a discharge frequency F4 (40.0 kHz), and a discharge frequency F5 (50.0 kHz) are X3, X4, and X5, respectively. As described above, the amount of ink, X3, is a maximum amount in the entire range of the discharge frequencies. Other amounts of ink, X4 and X5, become also almost a maximum amount similarly to the amount of ink, X3. The amounts of ink corresponding to a discharge frequency F6 (54.0 kHz) and a discharge frequency F7 (57.0 kHz) are X6 and X7, respectively. The amount of ink, X6, is slightly larger than the amount of ink, X2, and the amount of ink, X7, is an intermediate amount between the amount of ink, X2, and the amount of ink, X0.

As can be seen from the graph, the amount of ink droplet which is discharged varies depending on the discharge frequency. Such a change of the amount of ink is considered to be due to pressure vibration (residual vibration) which remains in the ink in the pressure chamber 43 after the discharging of the ink droplet. For example, it is assumed that in a period where ink pressure is increased due to residual vibration, the first decompression portion Pd1 of the discharge pulse PS is applied to the piezo element 45. In this case, a pressure change which is imparted to ink by the deformation of the piezo element 45 is cancelled out by a pressure change of ink caused by the residual vibration. That is, only a smaller pressure change than a pressure change which is imparted at the first decompression portion Pd1 is imparted to ink. Thus, it is presumed that the amplitude of the pressure vibration becomes smaller than the predetermined amplitude, so that the amount of ink which is discharged becomes smaller. On the other hand, it is assumed that in a period where ink pressure is lowered due to residual vibration, the first decompression portion Pd1 is applied to the piezo element 45. In this case, a pressure change which is imparted to ink by the deformation of the piezo element 45 is further strengthened by a pressure change of ink caused to the residual vibration. That is, a more pressure change than a pressure change which is imparted by the first decompression portion Pd1 can be imparted to ink. Thus, it is considered that it is possible to make the amplitude of the pressure vibration larger, so that it is possible to discharge ink of a more amount than the predetermined amount.

Consideration Based on Simulation Data

Figure 7:
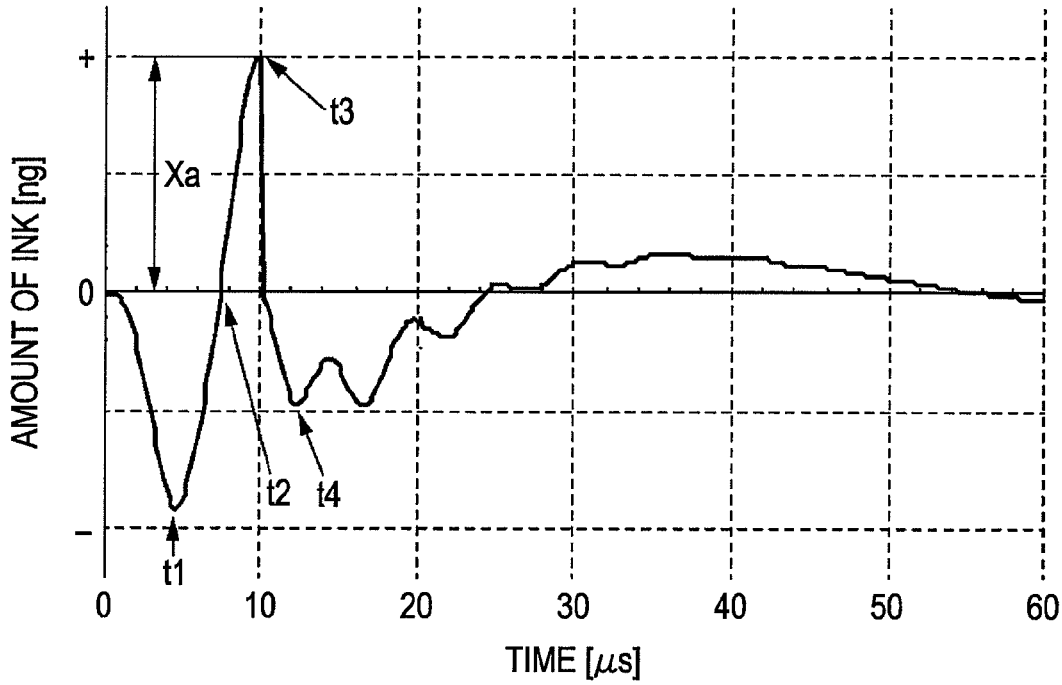
FIG. 7 is a view explaining a state variation of a meniscus in a case where an ink droplet was discharged by one discharge pulse.
Figure 8:
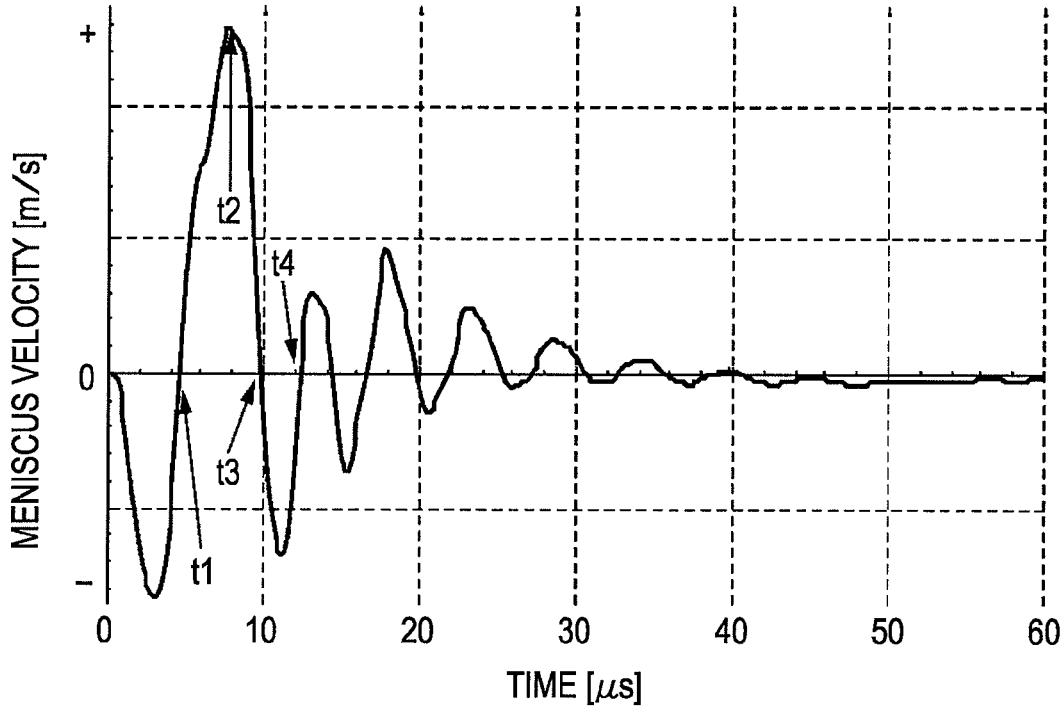
FIG. 8 is a view explaining a movement velocity of the meniscus in FIG. 7.

The above is considered based on simulation data. In FIG. 7, the vertical axis represents a state of a meniscus (the free surface of ink exposed in the nozzle 44) by the amount of ink, and horizontal axis represents time. With regard to the vertical axis, 0 represents a position of a meniscus in a steady state. Then, as a value increases to a positive side, the meniscus becomes a state where it is extruded in a discharge direction. To the contrary, as a value increases to a negative side, the meniscus becomes a state where it is drawn to the pressure chamber 43 side. The contents of the vertical axis and the horizontal axis are similarly applicable to the vertical axes and the horizontal axes of other drawings (FIG. 9 to FIG. 14). Therefore, the explanation in other drawings is omitted. In FIG. 8, the vertical axis represents a movement velocity of a meniscus, and the horizontal axis represents time. With regard to the vertical axis, 0 represents a state where a meniscus is not moved to any of the pressure chamber 43 side and a discharge side. For example, it corresponds to a state where the piezo element 45 does not operate and a meniscus remains stationary, a state where a meniscus moved to the pressure chamber 43 side is at a moment changing a movement direction to the discharge side, or, to the contrary, a state where a meniscus moved to the discharge side is at a moment changing a movement direction to the pressure chamber 43 side. Also, it is shown that as a value increases to a positive side, the movement velocity of a meniscus to the discharge side is increased, and as a value increases to a negative side, the movement velocity of a meniscus to the pressure chamber 43 side is increased.

First, the case of discharging an ink droplet by one discharge pulse PS is explained. In this case, as shown in FIG. 7, the first decompression portion Pd1 of the discharge pulse PS is applied to the piezo element 45. If the first decompression portion Pd1 is applied to the piezo element 45, the pressure chamber 43 expands from a reference volume up to a maximum volume. The ink in the pressure chamber 43 becomes a negative pressure state in accordance with the expansion, so that ink flows to the pressure chamber 43 side through the ink supply port 42. Also, as ink becomes a negative pressure state, a meniscus is drawn in to the pressure chamber 43 side (−side) within the nozzle 44.

The movement of the meniscus to the pressure chamber 43 side is continued even after the end of the application of the first decompression portion Pd1. That is, due to the wall portion partitioning the pressure chamber 43, the compliance of the vibration plate 46, or the like, the meniscus moves to the pressure chamber 43 side also during the application period of the first hold portion Ph1. Thereafter, at timing t1, the movement direction of the meniscus is inverted. At this time, the contraction of the pressure chamber 43 is also given in accordance with the application of the pressurization portion Pc1. Therefore, the ink pressure in the pressure chamber 43 is increased, so that the meniscus moves at a high speed to the discharge side (+side). The meniscus moved in accordance with the application of the pressurization portion Pc1 becomes a columnar shape. Then, at timing t3 after the end of the application of the pressurization portion Pc1 to the piezo element 45 (during the application of the second hold portion Ph2), an ink droplet is discharged from the nozzle 44. That is, a portion of the leading end side of the meniscus which becomes a columnar shape is cut into a droplet form and discharged. Also, in FIG. 7, the amount of ink, Xa, at the timing t3 represents the amount of the discharged ink droplet.

Due to the retroaction of the discharging, the meniscus returns at a fast speed to the pressure chamber 43 side. At that time, the second decompression portion Pd2 is applied to the piezo element 45, so that the pressure chamber 43 returns to a reference volume. The movement velocity of the meniscus is slowed down due to a volume change of this time. Then, after the meniscus has been sufficiently drawn in to the pressure chamber 43 side, the meniscus changes the movement direction to the discharge side (timing t4). Thereafter, the meniscus moves while changing the movement direction to the pressure chamber 43 side and the discharge side, thereby approaching a steady state. In this manner, the movement of the meniscus to the pressure chamber 43 side and the discharge side is due to a residual vibration after the discharging of an ink droplet, as described above. Accordingly, the pressure of the ink in the pressure chamber 43 varies with a Helmholtz period Tc.

The movement velocity of the meniscus shown in FIG. 8 is in a phase shift relationship with the amount of the ink of the meniscus. For example, at the timing t1 at which the meniscus was drawn in by the first decompression portion Pd1, the timing t3 of a moment at which the meniscus was discharged, and the timing t4 at which the meniscus was drawn in after the discharge of an ink droplet, the velocity of the meniscus represents 0. Also, at the timing t2 during the movement of an ink droplet to a discharge direction by the pressurization portion Pc1, the velocity of the meniscus represents a highest value.

FIG. 9 to FIG. 14 are views explaining the states of the meniscus in cases where two discharge pulses PS and PS were continuously applied to the piezo element 45 by varying the generation period Pwdis of the constant voltage portion Pi. As described above, an interval of the application of each of these discharge pulses PS and PS to the piezo element 45 corresponds to a period added the generation period Tb of the discharge pulse PS and the generation period Pwdis of the constant voltage portion Pi.

Figure 9:
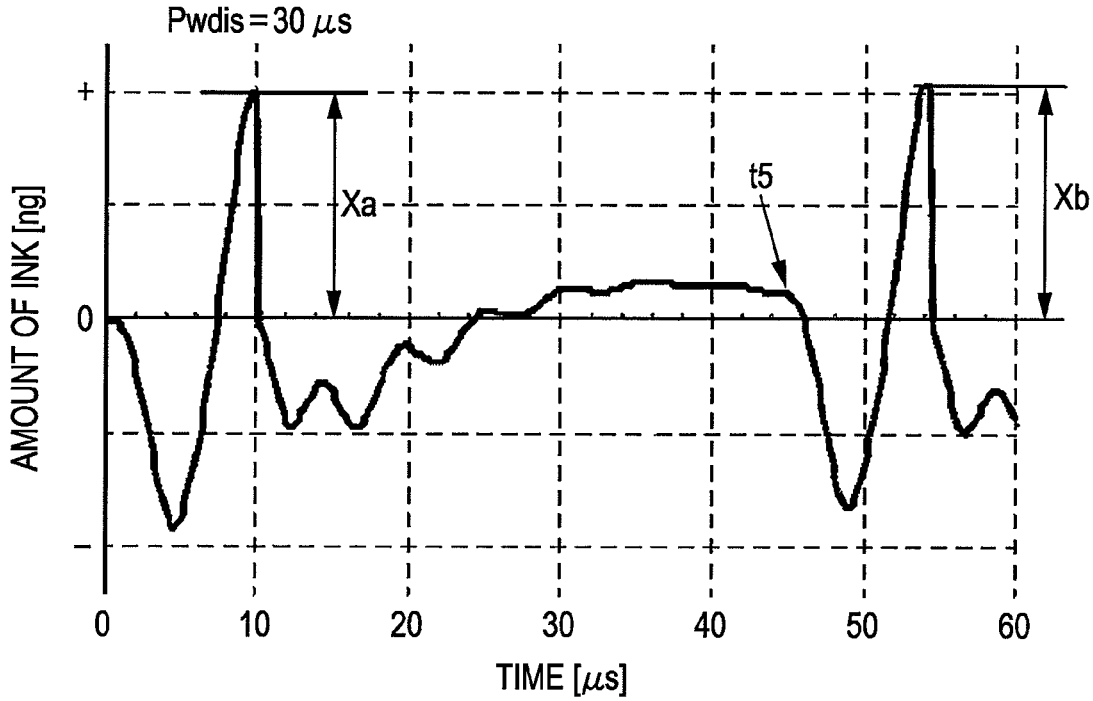
FIG. 9 is a view explaining a state variation of the meniscus in a case where a pulse interval was set as 30 μs.
Figure 10:
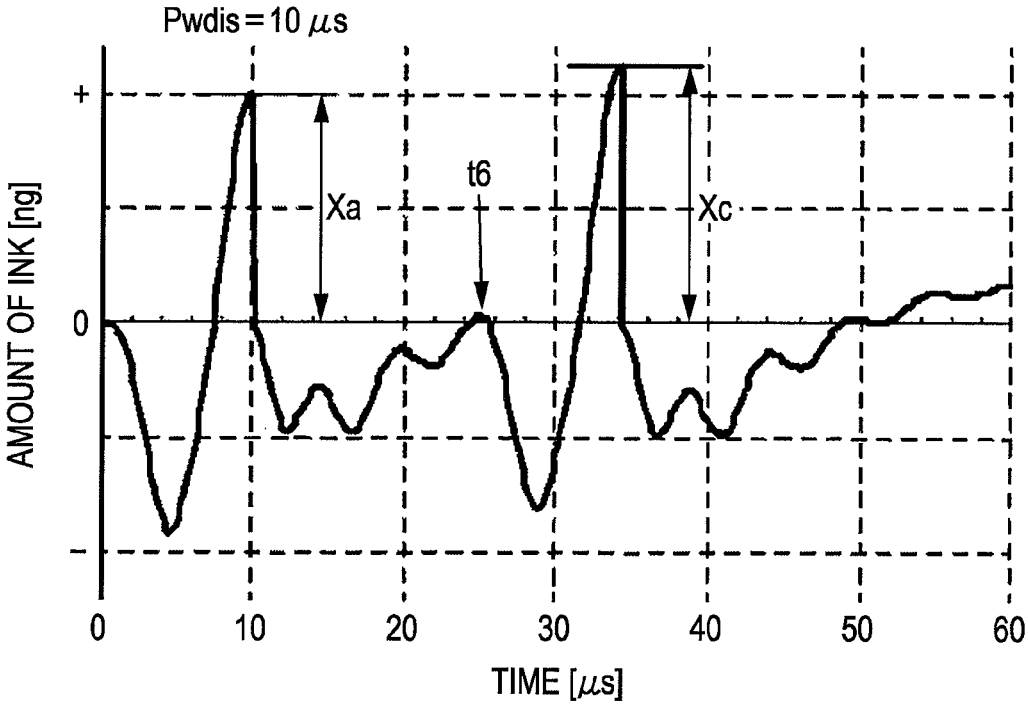
FIG. 10 is a view explaining a state variation of the meniscus in a case where a pulse interval was set as 10 μs.
Figure 11:
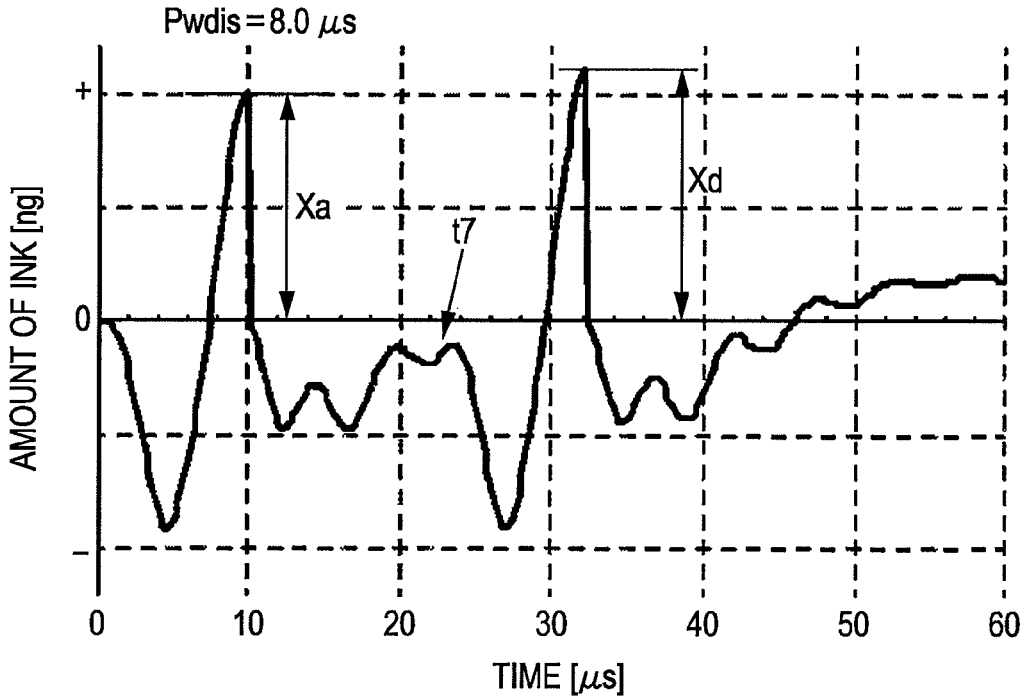
FIG. 11 is a view explaining a state variation of the meniscus in a case where a pulse interval was set as 8 μs.
Figure 12:
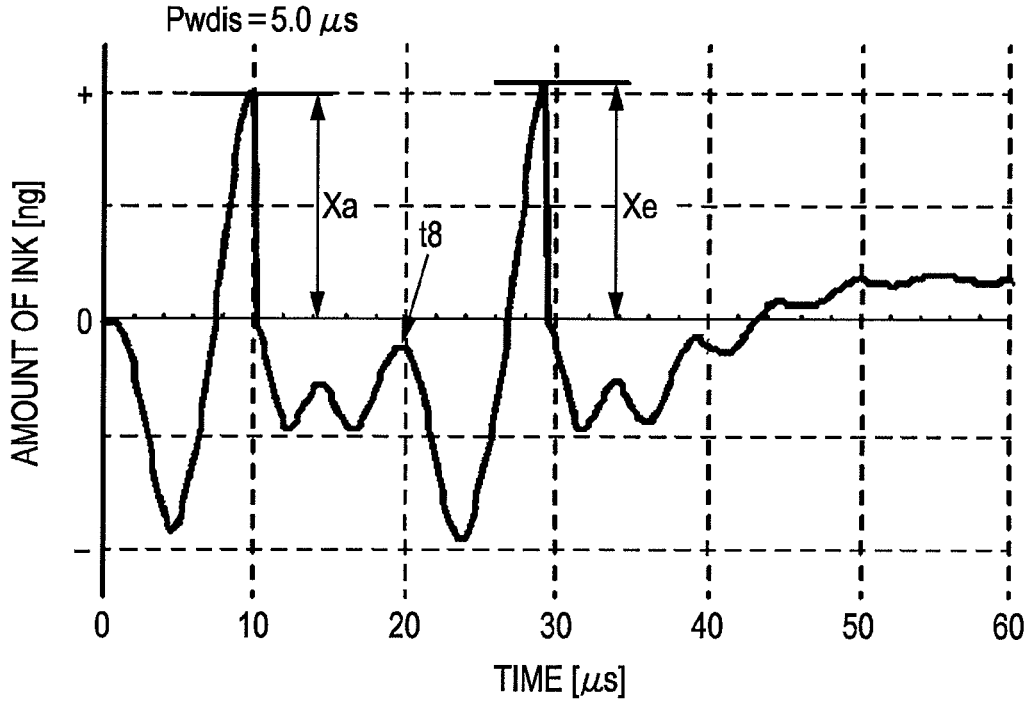
FIG. 12 is a view explaining a state variation of the meniscus in a case where a pulse interval was set as 5 μs.
Figure 13:
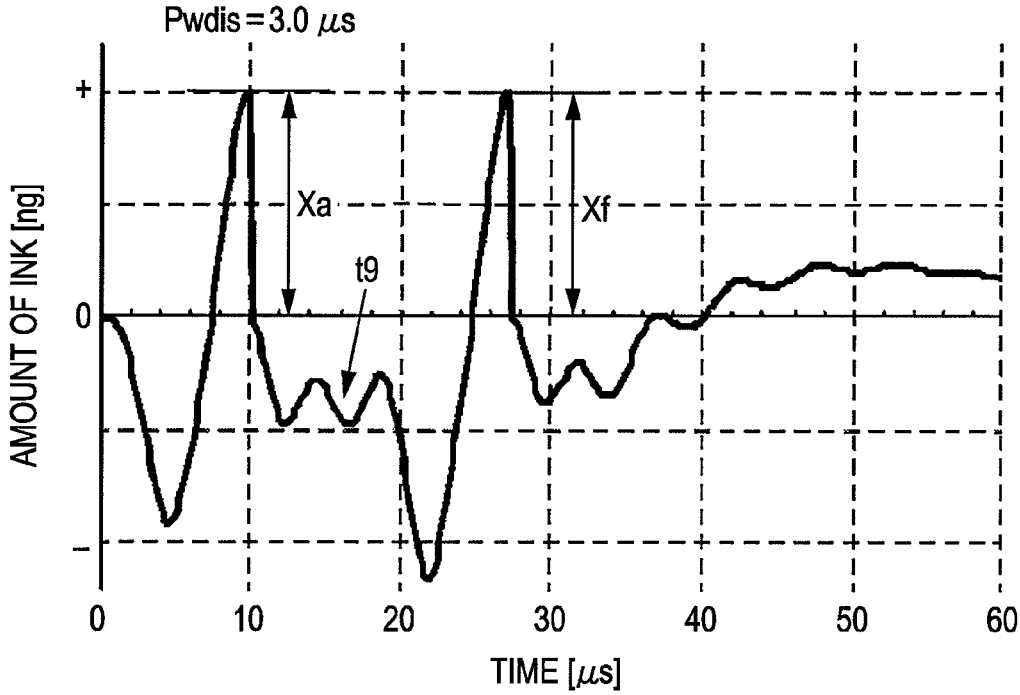
FIG. 13 is a view explaining a state variation of the meniscus in a case where a pulse interval was set as 3 μs.
Figure 14:
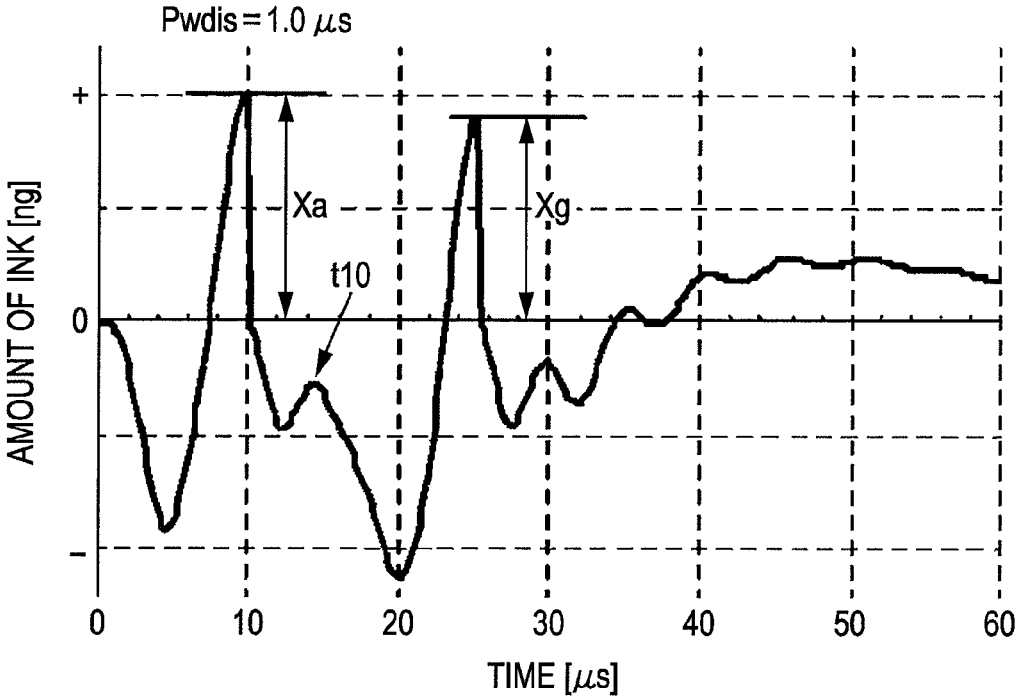
FIG. 14 is a view explaining a state variation of the meniscus in a case where a pulse interval was set as 1 μs.

As shown in FIG. 9, in a case where the generation period Pwdis of the constant voltage portion Pi was set to be 30 μs, the discharge amount Xb by the posterior discharge pulse PS becomes slightly larger than the discharge amount Xa by the prior discharge pulse PS. As shown in FIG. 10, in a case where the generation period Pwdis was set to be 10 μs, the discharge amount Xc by the posterior discharge pulse PS increases by approximately 10% compared to the discharge amount Xa by the prior discharge pulse PS. As shown in FIG. 11, also in a case where the generation period Pwdis was set to be 8 μs, the discharge amount Xd by the posterior discharge pulse PS increases by approximately 10% compared to the discharge amount Xa by the prior discharge pulse PS. As shown in FIG. 12, in a case where the generation period Pwdis was set to be 5 μs, the discharge amount Xe by the posterior discharge pulse PS slightly increases compared to the discharge amount Xa by the prior discharge pulse PS. As shown in FIG. 13, in a case where the generation period Pwdis was set to be 3 μs, the discharge amount Xf by the posterior discharge pulse PS becomes approximately the same as the discharge amount Xa by the prior discharge pulse PS. As shown in FIG. 14, in a case where the generation period Pwdis was set to be 1 μs, the discharge amount Xg by the posterior discharge pulse PS becomes smaller than the discharge amount Xa by the prior discharge pulse PS.

From the results of FIG. 9 to FIG. 14, it is presumed that due to the fact that the following factors influence one another, the discharge amounts Xb to Xg by the posterior discharge pulse PS varied.

As the first factor, the influence of the position of the meniscus at the time point (timing t5 to t10) of the start of the application of the posterior discharge pulse PS is conceived. For example, it is presumed that if the application of the posterior discharge pulse PS is started in a state where the meniscus rose to the discharge side further than the opening edge of the nozzle 44 (a state where the amount of ink is [+]), the amount of ink increases further than a case where the application of the posterior discharge pulse PS is started in a state where the meniscus was drawn in to the pressure chamber 43 side further than the opening edge of the nozzle 44 (a state where the amount of ink is [−]). This is considered to be due to the fact that the portion of the leading end side of the meniscus, which was extended in a columnar form, is torn due to surface tension.

As the second factor, the influence of the magnitude of ink pressure (the amplitude of a residual vibration) at the time point of the start of the application of the posterior discharge pulse PS is also conceived. As described above, the amplitude of a residual vibration is gradually reduced due to a loss and the like in the wall portion which partitions the pressure chamber 43. Then, the discharge amount by the posterior discharge pulse PS is affected also by the ink pressure at the time point of the start of the application of the posterior discharge pulse PS, the increase or the decrease of the ink pressure, a period from the increase to the decrease or vice versa, and the like. For example, in a case where the ink pressure at the time point of the start of the application of the posterior discharge pulse PS varies to an increase side and the energy of the increase is large, the energy of decompression by the first decompression portion Pd1 is cancelled out, and as a result, the discharge amount is decreased. Further, in a case where, although at the time point of the start of the application, ink pressure varies to an increase side, ink pressure varies to a decrease side during the application of the first decompression portion Pd1, the cancelled-out decompression energy is supplemented thereafter. Accordingly, the amount of ink varies also by a balance of the cancelled-out energy and the supplemented energy.

Concerning Driving Signal COM and Discharge Control

Next, the driving signal COM determined in consideration of a relationship between the discharge frequency and the discharge amount, and the discharge control of an ink droplet using the driving signal COM are explained.

Figure 15:
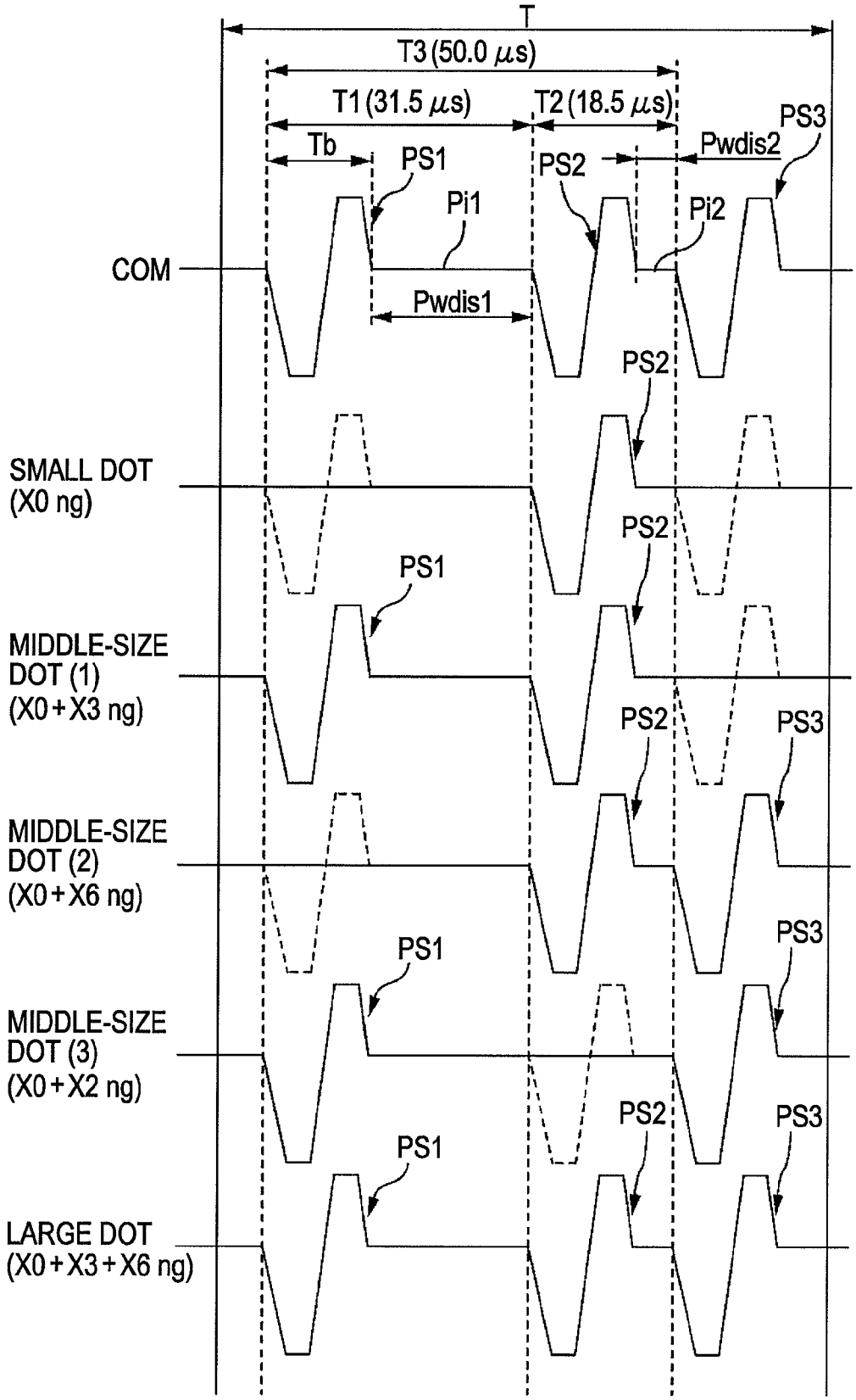
FIG. 15 is a view explaining the relationship between driving signals, discharge pulses which are applied to a piezo element, and dots which are formed.

The driving signal generation circuit 30 repeatedly generates the driving signal COM shown in the upper stage of FIG. 15 for every repetition period T. The driving signal COM has three discharge pulses PS1 to PS3 in the repetition period T. The waveforms of these discharge pulses PS1 to PS3 are the same as that of the discharge pulse PS of FIG. 5. Therefore, in a case where the respective discharge pulses PS1 to PS3 were solely applied to the piezo element 45 at sufficient intervals, the discharge amount becomes X0, as explained in FIG. 6B. Further, in accordance with the intervals of these discharge pulses PS1 to PS3, it is possible to change the discharge amount by the posterior discharge pulse PS (refers to FIG. 6B).

In the driving signal COM, the periods Pwdis1 and Pwdis2 from the end of the generation of the preceding discharge pulse to the start of the generation of the following discharge pulse are determined in accordance with the amount of an ink droplet which is discharged from the nozzle 44. That is, it can be said that the driving signal generation circuit 30 and the main control section 60, which serve as a pulse generation section, determine the periods Pwdis1 and Pwdis2 in accordance with the amount of an ink droplet which is discharged.

An interval T1 between the start of the first discharge pulse PS1 and the start of the second discharge pulse PS2 is 31.5 μs, and an interval T2 between the start of the second discharge pulse PS2 and the start of the third discharge pulse PS3 is 18.5 μs. Therefore, an interval T3 between the start of the first discharge pulse PS1 and the start of the third discharge pulse PS3 becomes 50.0 μs.

Here, a generation period per one of the respective discharge pulses PS1 to PS3 is Tb, as described above. Therefore, the constant voltage portion Pi1 between the discharge pulse PS1 and the discharge pulse PS2 is generated over the period Pwdis1 which subtracted the generation period Tb from the interval T1. Similarly, the constant voltage portion Pi2 between the discharge pulse PS2 and the discharge pulse PS3 is generated over the period Pwdis2.

The head control section HC selects the discharge pulse PS in accordance with the head control signal (a dot gradation value for every dot) from the main control section 60 and applies it to the piezo element 45. In the printer 1, dots can be formed into five kinds of sizes, such as a small dot, a middle-size dot (1), a middle-size dot (2), a middle-size dot (3), and a large dot. That is, the formation of dots is controlled with 6 gradations in which dot non-formation is added to the above-mentioned five kinds of sizes. Thus, the head control section HC selects the discharge pulse PS2 correspondingly to the gradation value of a small dot and selects the discharge pulses PS1 and PS2 correspondingly to the gradation value of a middle-size dot (1). Also, the head control section selects the discharge pulses PS2 and PS3 correspondingly to the gradation value of a middle-size dot (2) and selects the discharge pulses PS1 and PS3 correspondingly to the gradation value of a middle-size dot (3). Further, the head control section selects three discharge pulses PS1, PS2, and PS3 correspondingly to the gradation value of a large dot.

By performing such control, at the gradation value of a small dot, an ink droplet of X0 [ng] is discharged by the discharge pulse PS2, so that a small dot is formed on a paper. At the gradation value of a middle-size dot (1), an ink droplet of X0+X3 [ng] is discharged by the discharge pulses PS1 and PS2, so that a middle-size dot (1) is formed on a paper. At the gradation value of a middle-size dot (2), an ink droplet of X0+X6 [ng] is discharged by the discharge pulses PS2 and PS3, so that a middle-size dot (2) is formed on a paper. At the gradation value of a middle-size dot (3), an ink droplet of X0+X2 [ng] is discharged by the discharge pulses PS1 and PS3, so that a middle-size dot (3) is formed on a paper. At the gradation value of a large dot, an ink droplet of X0+X3+X6 [ng] is discharged by the respective discharge pulses PS1, PS2, and PS3, so that a large dot is formed on a paper.

Here, the middle-size dots (1) to (3) are explained. Ink droplets which are discharged by the prior discharge pulse PS have in common the amount of ink, X0. However, ink droplets which are discharged by the posterior discharge PS become the amounts of ink, X2, X3, and X6, respectively, which are different from one another. Also, the amount of ink, X2, is smallest, and the amount of ink, X3, is largest. Further, the amount of ink, X6, is larger than the amount of ink, X2, and smaller than the amount of ink, X3. Thus, the middle-size dot (1) among the middle-size dots (1) to (3) is largest, and the middle-size dot (3) is smallest. Further, the middle-size dot (2) is of a size between the middle-size dot (1) and the middle-size dot (3). That is, three kinds of middle-size dots which are different in size are formed by changing the discharge amount of an ink droplet by two discharge pulses PS having the same waveform.

As a result, in the printer 1, five kinds of dots which are different in size can be formed by three discharge pulses PS having the same waveform. That is, it is possible form the greater kinds of dots than in the past. Also, with regard to the length of the repetition period T, the repetition period includes only a period necessary for the generation of three discharge pulses PS and an interval (the generation period Pwdis of the constant voltage portion Pi) according to the amount of ink. Therefore, for the repetition period T, short time is enough rather than generating a new pulse, so that time needed to form one dot can be shortened.

Conclusion

As explained above, in the printer 1 of this embodiment, since the period Pwdis from the end of the generation of the preceding discharge pulse PS to the start of the generation of the following discharge pulse PS is determined in accordance with the amount of an ink droplet which is discharged from the nozzle 44, it is possible to change the amount of an ink droplet by the smaller kinds of discharge pulses PS than the case of using the discharge pulse PS for exclusive use. In this way, it is possible to increase the degree of freedom related to the discharge amount of ink.

Further, since the driving signal generation circuit 30 determines the period Pwdis from the end of the generation of the preceding discharge pulse PS which is generated in the repetition period T to the start of the generation of the following discharge pulse PS in accordance with the amount of an ink droplet which is discharged from the nozzle 44, it is possible to determine the discharge amount of an ink droplet with the repetition period T as a unit. Also, since the repetition unit corresponds to one dot, it is possible to increase the gradation of a dot. Also, as in this embodiment, by making the respective discharge pulses PS the same waveform, the DAC data (waveform generation data) can be used in common, so that the generation of each discharge pulse PS can be easily performed.

Further, since the head control section HC selectively applies each discharge pulse PS to the piezo element 45 in accordance with a gradation value, it is possible to further increase the degree of freedom related to the discharge amount of ink in accordance with the selection manner of the discharge pulse PS. In particular, as in this embodiment, if the repetition period T includes three discharge pulses PS or more, so that a combination of the preceding discharge pulse PS and the following discharge pulse PS is determined, it is possible to further increase the degree of freedom related to the discharge amount of ink.

Second Embodiment

In the first embodiment described above, the driving signal generation circuit 30 was configured to generate one kind of driving signal COM. Here, it is also acceptable that the driving signal generation circuit 30 generate the plural kinds of driving signals COM and the necessary portion of each driving signal COM is selectively applied to the piezo element 45. A second embodiment constituted in this manner is explained below.

Figure 16:
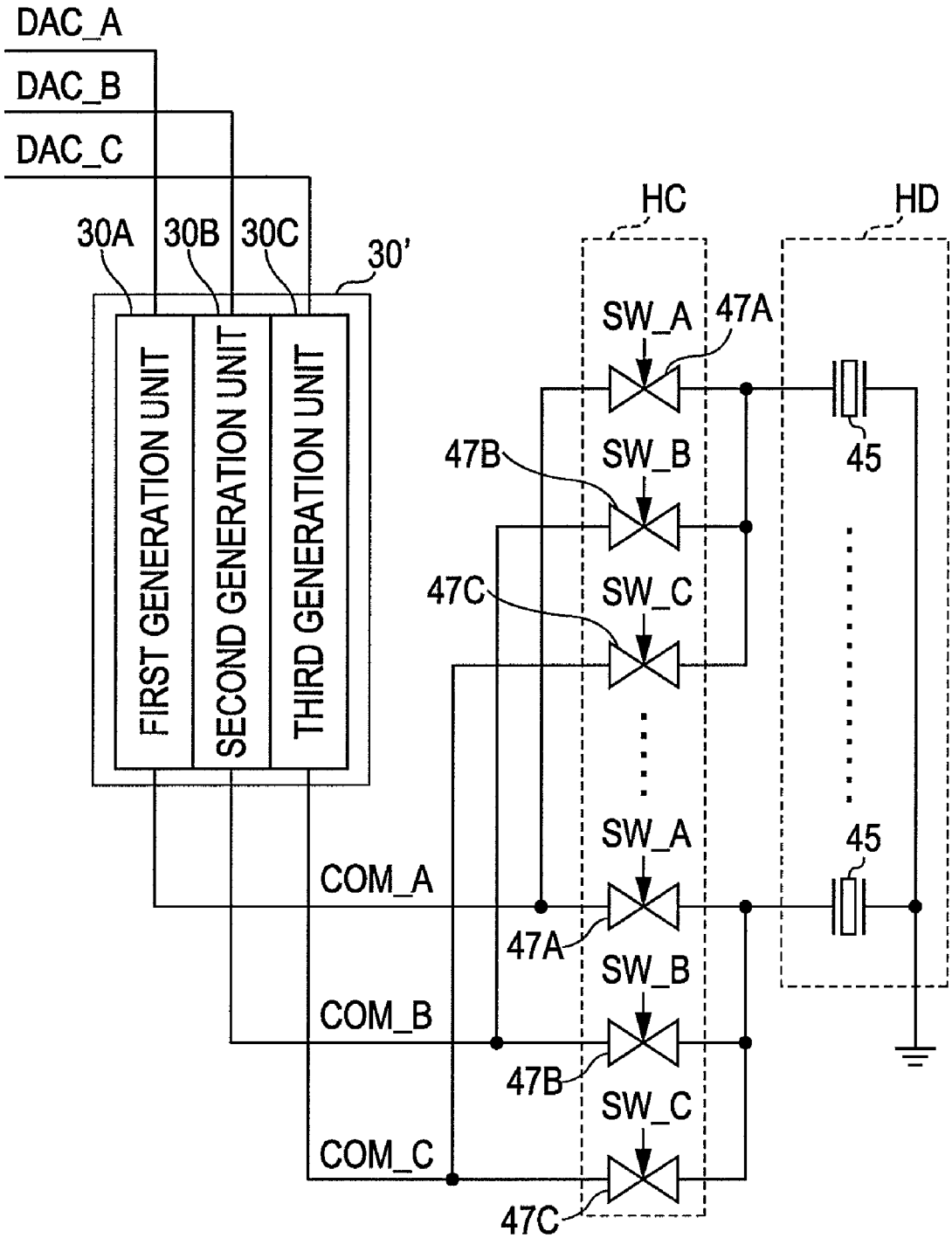
FIG. 16 is a block diagram of a driving signal generation circuit which is a principal section of a second embodiment, etc.

FIG. 16 is a block diagram explaining a driving signal generation circuit 30' of the second embodiment and the surrounding portions thereof. Since other portions are the same as those of the first embodiment, explanation is omitted. The driving signal generation circuit 30' includes a first generation unit 30A, a second generation unit 30B, and a third generation unit 30C. The first generation unit 30A is a portion which generates a first driving signal COM_A. Similarly, the second generation unit 30B is a portion which generates a second driving signal COM_B, and the third generation unit 30C is a portion which generates a third driving signal COM_C. These generation units have the same configuration. That is, similarly to the driving signal generation circuit 30 of the first embodiment explained in FIG. 4, each generation unit has the DAC circuit 31, the voltage amplifier circuit 32, and the current amplifier circuit 33.

The first generation unit 30A generates the first driving signal COM_A in accordance with a first DAC data (DAC_A) from the main control section 60. Similarly, the second generation unit 30B generates the second driving signal COM_B in accordance with a second DAC data (DAC_B), and the third generation unit 30C generates the third driving signal COM_C in accordance with a third DAC data (DAC_C). Although it will be described later, the driving signals COM_A to COM_C respectively include a plurality of discharge pulses PS11 to PS15, PS21 to PS25, and PS31 to PS35 within the repetition period T. Then, when each of the discharge pulses PS11 to PS15 included in the first driving signal COM_A is set to be a first preceding discharge pulse and a first following discharge pulse, each of the discharge pulses PS21 to PS25 included in the second driving signal COM_B, or each of the discharge pulses PS31 to PS35 included in the third driving signal COM_C corresponds to a second preceding discharge pulse and a second following discharge pulse. Similarly, when each of the discharge pulses PS21 to PS25 included in the second driving signal COM_B is set to be the first preceding discharge pulse PS and the first following discharge pulse, each of the discharge pulses PS11 to PS15 included in the first driving signal COM_A, or each of the discharge pulses PS31 to PS35 included in the third driving signal COM_C corresponds to the second preceding discharge pulse and the second following discharge pulse. That is, when one of the three generation units becomes a first pulse generation section, the other two become a second pulse generation section.

Since the driving signal generation circuit 30' generates three kinds of driving signals COM_A to COM_C, the head control section HC is provided with switches 47A to 47C correspondingly to three kinds of driving signals COM_A to COM_C, respectively. In this way, the respective driving signals COM_A to COM_C can be selectively applied to the respective piezo elements 45.

Figure 17:
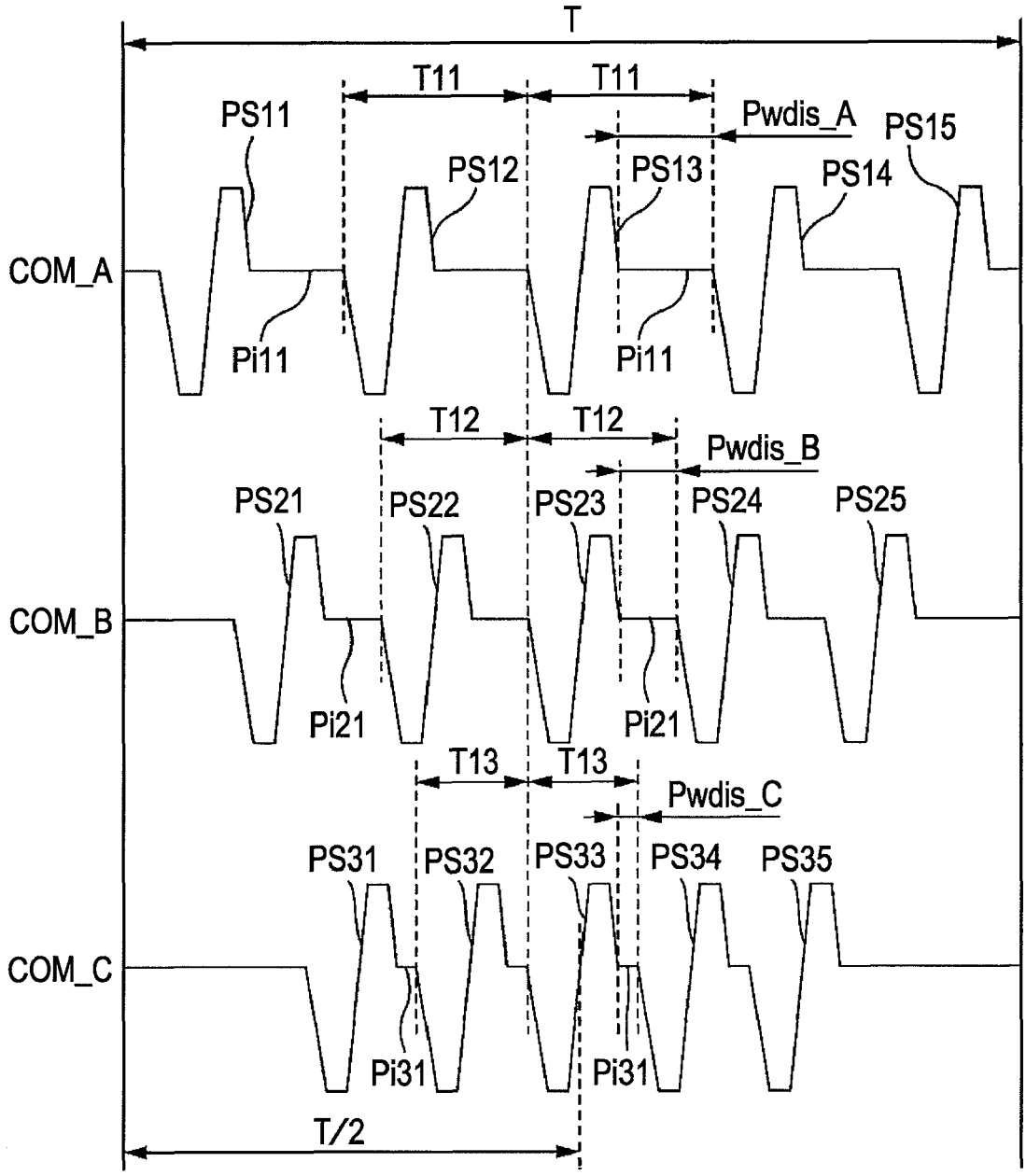
FIG. 17 is a view explaining driving signals of the second embodiment.

As shown in the upper stage of FIG. 17, the first driving signal COM_A generates five discharge pulses PS11 to PS15 at intervals T11. The second driving signal COM_B generates five discharge pulses PS21 to PS25 at intervals T12, and the third driving signal COM_C generates five discharge pulses PS31 to PS35 at intervals T13. The respective discharge pulses included in each of the driving signals COM_A to COM_C have the same waveform. Here, comparing the intervals T11 to T13, the interval T11 is longest, and the interval T13 is shortest. Then, the interval T12 has a length between the interval T11 and the interval T13. Accordingly, the discharge frequency when applying five discharge pulses to the piezo element 45 is highest in the third driving signal COM_C and is second highest in the second driving signal COM_B. Then, in the first driving signal COM_A, the discharge frequency is lowest. Accordingly, with regard to generation periods Pwdis_A to Pwdis_C of constant voltage portions Pi11 to Pi31 which are generated between the discharge pulses, the constant voltage portion Pi31 of the third driving signal COM_C is shortest, and the constant voltage portion Pi21 of the second driving signal COM_B is second shortest. Then, the constant voltage portion Pi11 of the first driving signal COM_A is longest.

In addition, in this embodiment, any driving signal COM generates the third discharge pulses PS13, PS23, and PS33 in the middle of the repetition period T, and the generation start timing of the prior and posterior discharge pulses PS with each of these discharge pulses PS13, PS23, and PS33 as a reference is determined. According to this, the centers of large dots which are generated in the respective driving signals COM are aligned, so that image unevenness due to a landing position discrepancy can be suppressed.

As explained in the first embodiment, the amount of an ink droplet which is discharged by the posterior discharge pulse varies in accordance with the intervals T11 to T13 of the respective discharge pulses. Therefore, by discharging an ink droplet by appropriately selecting the discharge pulses included in each driving signal COM, it is possible to discharge the desired amount of ink droplet. Also, as in the discharge frequencies F3 to F5 in FIGS. 6A and 6B, even if the discharge frequencies are different, it is also possible to discharge almost the same amount of ink droplet. In this case, by appropriately selecting the interval, it is also possible to finely adjust the landing position of an ink droplet. This is effective in a case where although the amount of an ink droplet necessary to form a dot is determined, the landing position of an ink droplet which is discharged by the posterior discharge pulse PS must be very precisely controlled.

Concerning Other Embodiments

The above-mentioned embodiments mainly describe the printing system having the printer 1 as the liquid discharging apparatus. However, the description includes the disclosure of a liquid discharging method or a liquid discharging system. Further, the disclosure of a liquid discharge head or a control method of the liquid discharge head is also included. Also, the embodiments are for the easy understanding of the invention, not for construing the invention as being limited to it. The invention can be modified or improved without departing from the purpose of the invention, and also it is needless to say that the equivalent thereto is included in the invention. In particular, embodiments which are described below are also to be included in the invention.

Discharge Pulse Setting Method of Liquid Discharge Head

In the above-described embodiments, a pulse distance between the preceding and following discharge pulses PS, or the discharge pulse PS to be selected is determined in accordance with the amount of an ink droplet (liquid droplet) which is discharged from the nozzle 44. However, the invention is not limited to this.

In this type of head HD (liquid discharge head provided with nozzles), there is a case where a difference occurs in the discharge amount due to a manufacturing variation, etc. Thus, the discharge pulse PS to be selected, or a pulse distance between the discharge pulses PS may also be determined in accordance with liquid discharge characteristic information which represents a difference from the discharge amount of a standard head HD. Here, as the liquid discharge characteristic information, variation information which directly represents a difference from the discharge amount of a standard head HD, Helmholtz Tc which indirectly represents the difference, and ink droplet flight velocity information can be given as example.

Then, at the time of the manufacturing or the inspection of each head HD, a difference of the discharge amount of each head HD from the discharge amount of a standard head HD is determined as the liquid discharge characteristic information, and when mounting the head HD in the printer 1 (in other words, when manufacturing the liquid discharging apparatus or the printing apparatus), the discharge pulse PS based on the liquid discharge characteristic information is set.

For example, in FIG. 17, a standard head HD is assumed as discharging ink droplets at a given discharge amount by the discharge pulses PS21 to PS25 of the second driving signal COM_B. Then, a certain head HD is assumed as discharging ink droplets at a given discharge amount by the discharge pulses of the first driving signal COM_A, unlike the discharge amount of the standard head HD. In such a case, as the information of the discharge pulse PS for discharging a given discharge amount, the information on the discharge pulses PS11 to PS15 of the first driving signal COM_A is stored in the memory 63 of the printer 1 into which a certain head HD is incorporated. Similarly, in another head HD in which a given discharge amount is obtained by the discharge pulses PS31 to PS35, the third driving signal COM_C is set. That is, the information on the discharge pulses PS31 to PS35 is stored in the memory 63.

Further, the setting may also be carried out at the time of the assembly of the printer 1, or may also be carried out at the time of the use of the printer 1.

Concerning Driving Signal COM, etc

The driving signal COM in each embodiment described above is one example, various aspects are conceivable. For example, with regard to the discharge pulse, the plural kinds of discharge pulses which are different in waveform may also be included in the driving signal COM. Also, with regard to the driving signal generation circuits 30 and 30', they are not limited to a mode which generates a driving waveform by the DAC circuit 31 explained in the above-described embodiments. For example, they may also be a mode which generates the driving signal COM by an analog circuit. In short, any mode is acceptable, provided that it generates the driving signal COM.

Concerning Other Applications

In the embodiments described above, gradation recording which forms the plural kinds of dots was explained. However, the invention is not limited to this aspect. For example, the invention can also be applied to the adjustment of the discharge amount when forming a white ink layer on the surface of a base material. Also, the invention can also be applied to the adjustment of the discharge amount when undercoating a gloss adjusting material on the surface of a base material, the adjustment of the discharge amount when forming an overcoat layer on the surface of an image, and the formation of a bonding layer.

Also, in the above-described embodiments, as the liquid discharging apparatus, the printer 1 has been explained. However, the invention is not to be limited to this. For example, the same technology as the above-described embodiments may also be applied to various liquid discharging apparatuses to which ink jet technology is applied, such as a color filter manufacturing apparatus, a dyeing apparatus, a micro-fabrication apparatus, a semiconductor manufacturing apparatus, a surface fabrication apparatus, a three-dimensional modeling device, a liquid vaporization apparatus, an organic EL manufacturing apparatus (in particular, a high molecule EL manufacturing apparatus), a display manufacturing apparatus, a film formation apparatus, a DNA chip manufacturing apparatus. Also, the methods or manufacturing methods of them are also in the category of an application range.

What is claimed is:

1. A liquid discharging apparatus comprising:

a pressure chamber communicated with a nozzle;

an element which performs the operation of imparting a pressure change to liquid in the pressure chamber; and a pulse generation section which generates a preceding discharge pulse and a following discharge pulse in a repetition period that operate the element, and adjusts a period from the end of the generation of the preceding discharge pulse to the start of the generation of the following discharge pulse within the repetition period in accordance with the liquid droplet amount which is discharged from the nozzle.

2. The liquid discharging apparatus according to claim 1, wherein the pulse generation section repeatedly generates the preceding discharge pulse and the following discharge pulse for every repetition period, and also determines a period from the end of the generation of the preceding discharge pulse, which is generated in the same repetition period, to the start of the generation of the following discharge pulse in accordance with the liquid droplet amount which is discharged from the nozzle.

3. The liquid discharging apparatus according to claim 1, further comprising: a pulse application section which selectively applies the preceding discharge pulse and the following discharge pulse to the element.

4. The liquid discharging apparatus according to claim 3, wherein the pulse generation section generates three discharge pulses or more in the repetition period, and the pulse application section determines a combination of the preceding discharge pulse and the following discharge pulse, which is applied to the element, in accordance with the liquid droplet amount which is discharged from the nozzle.

5. The liquid discharging apparatus according to claim 1, wherein the pulse generation section includes:

a first pulse generation section which generates a first preceding discharge pulse and a first following discharge pulse; and a second pulse generation section which generates a second preceding discharge pulse and a second following discharge pulse, such that a period from the end of the generation of the second preceding discharge pulse to the start of the generation of the second following discharge pulse is different from a period from the end of the generation of the first preceding discharge pulse to the start of the generation of the first following discharge pulse.

6. The liquid discharging apparatus according to claim 1, wherein the preceding discharge pulse and the following discharge pulse have the same waveform.

7. A liquid discharging method of discharging liquid from a nozzle by using a liquid discharging apparatus which includes a pressure chamber communicated with the nozzle, an element which performs the operation of imparting a pressure change to liquid in the pressure chamber, and a pulse generation section which generates pulses in a repetition period that operate the element, the method comprising:

generating a preceding discharge pulse which operates the element;

operating the element by the preceding discharge pulse;

generating a following discharge pulse after a period, which is adjusted in accordance with the liquid droplet amount discharged from the nozzle, has elapsed since the end of the generation of the preceding discharge pulse within the repetition period; and operating the element by the following discharge pulse.

8. A discharge pulse setting method of a liquid discharging apparatus which includes a liquid discharge head provided with a pressure chamber communicated with a nozzle, and an element which performs the operation of imparting a pressure change to liquid in the pressure chamber; and a pulse generation section which generates a preceding discharge pulse and a following discharge pulse in a repetition period which operate the element, the setting method comprising:

adjusting a period from the end of the generation of the preceding discharge pulse to the start of the generation of the following discharge pulse within the repetition period in accordance with the discharge characteristic information of the liquid discharge head.

* * * * *